US005563473A

United States Patent [19]

Mattas et al.

[11] Patent Number: 5,563,473

[45] Date of Patent: Oct. 8, 1996

[54] ELECTRONIC BALLAST FOR OPERATING LAMPS IN PARALLEL

[75] Inventors: Charles B. Mattas, Glenview, Ill.; Robert A. Erhardt, Torrance, Calif.

[73] Assignee: Philips Electronics North America Corp., New York, N.Y.

[21] Appl. No.: 458,209

[22] Filed: Jun. 2, 1995

Related U.S. Application Data

[63] Continuation-in-part of Ser. No. 329,700, Oct. 26, 1994, Pat. No. 5,463,284, which is a continuation of Ser. No. 932,840, Aug. 20, 1992, abandoned.

[51] Int. Cl.[6] ..... H05B 37/00

[52] U.S. Cl. ..... 315/240; 315/227 R; 315/244; 315/289; 315/DIG. 5

[58] Field of Search ..... 315/240, 244, 315/289, 227 R, DIG. 5, DIG. 2, DIG. 7, 241 R

[56] References Cited

U.S. PATENT DOCUMENTS

| | | | |
|---|---|---|---|
| 4,388,562 | 6/1983 | Josephson | 315/205 |
| 4,396,866 | 8/1983 | Bay et al. | 315/106 |
| 4,641,061 | 2/1987 | Munson | 315/210 |
| 5,013,974 | 5/1991 | Nilssen | 315/244 |
| 5,175,470 | 12/1992 | Garbowicz | 315/106 |
| 5,214,356 | 5/1993 | Nilssen | 315/224 |
| 5,463,284 | 10/1995 | Mattas | 315/240 |

OTHER PUBLICATIONS

Product Bulletin, Valmont Elecric, Ultra–Miser II–U232PR120S/U232PR277S.

MicroBallast–MTI.

Product News, MagneTek Lighting Products, May 4, 1994.

MicroBallast 277 and 120 Volts.

"An Economical Controller Corrects Power Factor", by Jade H. Alberkrack and Steven M. Barrow, Motorola, Inc. Bipolar Analog I.C. Division, Tempe, AZ.

Motorola Semiconductor Technical Data, Advance Information Power Factor Controller, MC34262.

International Rectifier, Self–Oscillating Half–Bridge Driver–IR2151, Data Sheet No. PD–6.034.

Microballast, MTI International, Talbot Steele, Bob Wisbey and Jeff Irmer Sept. 10, 1993.

*Primary Examiner*—Frank Gonzalez
*Assistant Examiner*—Reginald A. Ratliff
*Attorney, Agent, or Firm*—Edward Blocker

[57] ABSTRACT

An electronic ballast for powering at least two rapid start, parallel connected fluorescent lamps. Associated with each lamp is a serially connected choke and capacitor combination. A train of pulses of alternating polarity having a fundamental frequency, which is generated by an inverter, is applied to each serially connected combination. Each combination is characterized by a resonant frequency which is other than an odd harmonic of and at least two times and preferably $\sqrt{5}$ times greater than the fundamental frequency. Reduction in filament heating, following lamp ignition, is provided through the addition of voltages applied to each filament which are substantially out of phase with each other.

42 Claims, 6 Drawing Sheets

| | | | | |
|---|---|---|---|---|
| R1 | 274K, | 1/2W, | 1% | |
| R3 | 1.5K, | 1/4W, | 1% | |
| R5 | 91K, | 1/2W, | 5% | |
| R6 | 22, | 1/4W, | 5% | |
| R7 | 22.1K, | 1/4W, | 1% | |
| R8 | 10, | 1/4W, | 5% | |
| R9 | 300, | 1/4W, | 5% | |
| R10 | 0.47, | 1/2W, | 5% | |
| R12 | 442K, | 1/2W, | 1% | |
| R13 | 4.75K, | 1/4W, | 1% | |
| R14 | 2M, | 1/4W, | 5% | |
| R17 | 100K, | 1/2W, | 5% | |
| R18,R19 | 150, | 1/4W, | 5% | |
| R20 | 22, | 1/2W, | 5% | |
| R23 | 24.3K, | 1/4W, | 1% | |
| R24 | 51, | 1/4W, | 5% | |
| R25,26 | 0.68, | 1/2W, | 5% | |
| R27 | 0.33, | 1/2W, | 5% | |
| C3,C4 | 3300PF, | 3KV, | 20% | |
| C5,C8,C9 | 1.0UF, | 250V, | 10% | |
| C6 | 47UF, | 315V, | 20% | |
| C10 | 1500PF, | 1KV, | 10% | |
| C11,C12 | 0.22UF, | 630V, | 5% | |
| C15,C16 | 680PF | 500VAC, | 5% | |
| C19 | 1.0UF, | 50V, | 5% | |
| C21,C23,C24 | 0.1UF | 50V, | 10% | |
| C22 | 0.001UF, | 50V, | 2% | |
| C25 | 100UF, | 35V, | 10% | |
| C26 | 1000PF, | 50V, | 10% | |
| C27 | 0.33UF, | 50V, | 5% | |
| C30 | 220PF, | 1KV, | 20% | |
| L1,L2 | 0.40MH EMI INDUCTOR | | | |
| L4,L5 | 6.9 CHOKE TRANSFORMER | | | |
| MAIN | 405 TURNS | | | |
| SECTIONS 97,99 | 6 TURNS | | | |
| AUXILIARY 91,93 | 3 TURNS | | | |
| T3 | CHOKE TRANSF. PRECOND. | | | |
| T4 | POWER TRANSF. (PRIMARY 700UH ) | | | |
| PRIMARY 71 | 59 TURNS | | | |
| SECTION 75 | 3 TURNS | | | |
| SECTION 77 | 137 TURNS | | | |
| AUXILIARY 95,101 | 2 TURNS | | | |
| D1,D2,D3,D4,D6 | IN4004, | 1.0A, | 400V | |
| D5 | BYV36C, | 1.6A, | 600V, | FAST REC. |
| D7,D9,D10,D12,D13 | 1N4148, | 150MA, | 75V | |
| D11 | BYD33J, | 1.0A, | 600V, | FAST REC. |
| Q1,Q2,Q3 | IRF730, | 5.5A, | 400V | |
| IC1 | MC 34262P (DIP-8) | | | |
| IC2 | IR 2151 (DIP-8) | | | |
| F1 | 10A, | 125V | | |
| VR1 | 150V, | 10% | | |

FIG. 7

ELECTRONIC BALLAST FOR OPERATING LAMPS IN PARALLEL

CROSS-REFERENCE TO RELATED APPLICATION

This application is a continuation-in-part of application Ser. No. 08/329,700, filed Oct. 26, 1994, now U.S. Pat. No. 5,463,284, which is a continuation of application Ser. No. 07/932,840, filed Aug. 20, 1992, now abandoned.

BACKGROUND OF THE INVENTION

This invention relates generally to a lamp ballast, and more particularly to an electronic ballast for operating two or more pre-heated, fluorescent lamps in parallel.

Conventional rapid start ballasts for powering two or more pre-heated, fluorescent lamps typically operate the lamps in series with a starting capacitor across all but one lamp. Use of a starting capacitor generally results in an increase in glow current when starting the lamp. This increase in glow current frequently lowers the life expectancy of the lamp.

Conventional instant start ballasts for powering two or more fluorescent lamps typically operate the lamps in parallel. Operating conditions for each lamp are dependent on the operation of every other lamp. When any one of the parallel connected lamps fails to operate, there is a change in lamp load. A mismatch in the power outputted by the ballast and the lamp load results. Operation of each parallel connected lamp remaining in operation is adversely affected. In other words, the lamps do not operate independently of one another other.

A conventional lamp ballast often drives its inverter at two different frequencies, that is, at a resonant frequency during pre-ignition of the lamp load and at a steady-state operating frequency. Sensing circuitry to determine when to switch from the resonant frequency to the steady state operating frequency is often required.

The resonant frequency is typically based on the series combination of an inductor L and a capacitor C. It is particularly difficult to operate at or near the resonant frequency of the series L-C circuit before lamp ignition inasmuch as unsafe, high voltages and current levels can occur (i.e. above the maximum ratings of one or more ballast circuit components). By operating below resonance during pre-ignition of the lamp load, capacitive switching of the inverter can easily occur producing high switching losses. Additional circuitry is therefore required to prevent the switching frequency of the inverter from operating below the series L-C circuit resonant frequency during pre-ignition of the lamp load.

Accordingly, it is desirable to provide a lamp ballast for powering two or more pre-heated, fluorescent lamps. The lamps should be operated independently of each other. Reduction in lamp life arising from glow currents should be minimized. The ballast should have safe open circuit (i.e., pre-ignition) voltage and current levels, with relatively low switching losses. The improved lamp ballast should operate at single frequency which is well below the resonant frequency of the series L-C circuit.

SUMMARY OF THE INVENTION

Generally speaking, in accordance the invention, a ballast circuit for powering at least two rapid start fluorescent lamps includes at least two serially connected combinations of a choke and a capacitor. Each combination is associated with a different lamp. The ballast circuit also includes a generator for applying a generated signal to each serially connected combination. The generated signal has a fundamental frequency. Each combination is characterized by a resonant frequency which is other than an odd harmonic of and at least $\sqrt{5}$ times greater than the fundamental frequency.

By operating in this region during pre-ignition, safe voltage and current levels can be maintained. The generated signal results in safe non-resonant operation before lamp ignition as well as correct lamp current after ignition. Feedback circuitry for sensing ignition of the lamp load for switching to a different steady-state lamp operating frequency need not be provided.

By providing an independent resonant series circuit associated with each lamp, each lamp can be operated independently of one another. Accordingly, and unlike conventional instant start, parallel lamp operation, failure of one or more lamps does not adversely affect the performance of the ballast in properly powering the remaining lamp load.

Each lamp includes a first filament and a second filament. In accordance with one feature of the invention, a first source of voltage and an auxiliary source of voltage are applied across each filament. Prior to lamp ignition, the voltages from the first source and auxiliary source are substantially in phase with each other. Following lamp ignition, the voltages from the first source and auxiliary source are substantially out of phase with each other. Consequently, the voltage across each filament prior to lamp ignition is sufficient to pre-heat the filaments. The voltage across each filament following lamp ignition is substantially reduced. Filament heating following lamp ignition is therefore significantly lowered resulting in higher system efficiency.

In accordance with a feature of the invention, the resonant frequency of each series connected L-C combination is less than the third harmonic frequency of a generated square wave drive thereby avoiding unsafe third harmonic voltages and current levels during pre-ignition of the lamp load. Substantially the same generated signal frequency is used during pre-ignition and steady-state operation of the lamp load. In yet another feature of the invention, the resonant frequency of each series connected L-C combination is greater than two times the fundamental frequency.

In accordance with yet another feature of the invention, the generator initially produces after ballast turn-on a generated signal having a magnitude sufficient for heating the lamp filaments but insufficient for starting the lamps. After a predetermined time delay sufficient for pre-heating the filaments, the magnitude of the generated signal is increased to ignite the lamps.

The serial connected combinations are effectively connected together in parallel with each capacitor coupled to a different lamp. The lamps therefore operate in parallel. Starting capacitors, required for lamps connected serially together, are eliminated. The reduction in lamp life arising from an increase in glow current through use of a starting capacitor is avoided.

In accordance with another aspect of the invention, a method for powering at least two rapid start fluorescent lamps includes the steps of producing a square wave having a fundamental frequency and applying the square wave to at least two serially connected combinations of a choke and a capacitor. Each combination is associated with a different lamp and is characterized by a resonant frequency which is other than an odd harmonic of at least $\sqrt{5}$ times greater than the fundamental frequency.

The method can also include the step of applying to each lamp filament the sum of a first voltage and a second voltage. The first voltage and second voltage are substantially in phase with each other prior to lamp ignition and are substantially out of phase with each other following lamp ignition.

Accordingly, it is an object invention to provide an improved ballast for operating two or more lamps in which each lamp is operated independently of one another.

It is another object of the invention to provide an improved ballast in which the same inverter driving signal can be used during pre-ignition and steady-state operation of the lamp load.

It is a further object of the invention to provide an improved ballast for operating two or more pre-heated, fluorescent lamps in which the adverse impact of glow current in affecting lamp life is minimized.

It is still another object of the invention to provide an improved ballast circuit which eliminates the need for feedback circuitry for sensing lamp ignition for changing the inverter frequency.

It is still a further object of the invention to provide an improved ballast circuit in which the inverter driving signal frequency is substantially less than the resonant frequency of a series connected L-C output circuit during pre-ignition of the lamp load.

Still other objects and advantages of the invention, will, in part, be obvious and will, in part, be apparent from the specification.

The invention accordingly comprises several steps in a relation of one or more of such steps with respect to each of the others, and the device embodying features of construction, a combination of elements and arrangement of parts which are adapted to effect such steps, all is exemplified in the following detailed disclosure and the scope of the invention will be indicated in the claims.

BRIEF DESCRIPTION OF DRAWINGS

For a fuller understanding of the invention, reference is had to the following description taken in connection with the accompanying drawings, in which:

FIG. 7 is a tabular listing and description of the ballast circuit components of FIG. 3.

DETAILED DESCRIPTION OF THE PREFERRED EMBODIMENT

Figure 1:
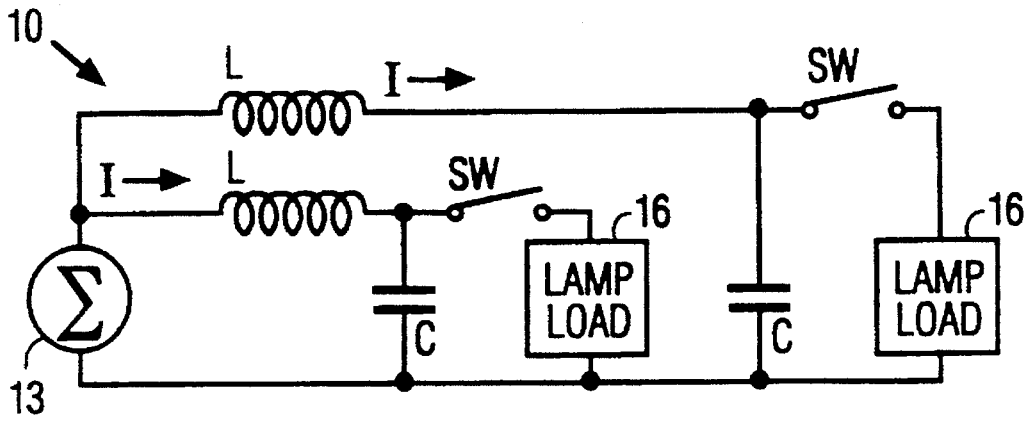
FIG. 1 is a circuit diagram of a ballast output circuit in accordance with the present invention.

The figures shown herein illustrate a preferred embodiment of the invention. Those elements/components shown in more than one figure of the drawings have been identified by like reference numerals/letters and are of similar construction and operation.

Figure 2A:
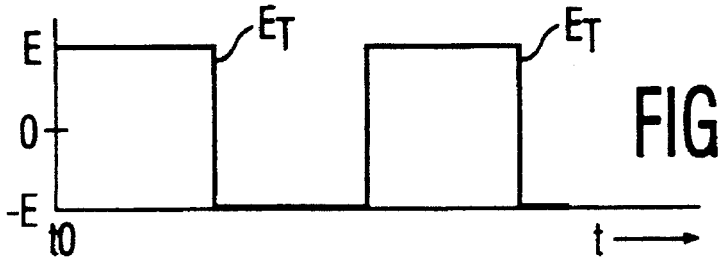
FIGS. 2(*a*), 2(*b*) and 2(*c*) are timing diagrams of a half-bridge inverter output voltage, output current at its fundamental frequency and output current at its third harmonic, respectively.
Figure 2B:
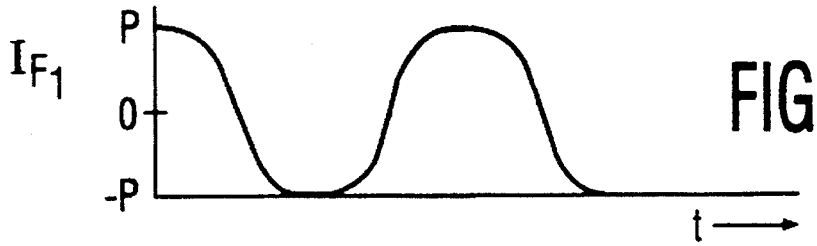
Figure 2C:
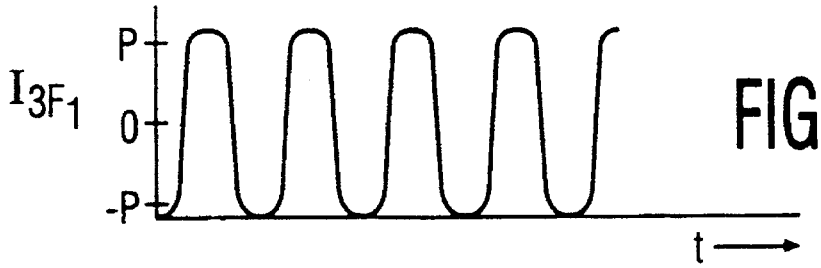

Referring now to FIGS. 1, 2(*a*), 2(*b*) and 2(*c*), a ballast output circuit 10 includes at least two serial connected combinations of an inductor L and a capacitor C connected across the output of a square wave generator 13. Square wave generator 13 is preferably, but not limited to, a half-bridge inverter generating a voltage E (i.e. the inverter output voltage). A lamp load 16 is connected across each capacitor C through a switch SW. Switches SW are shown merely for the purpose of simulating the pre-ignition and ignition states of the lamps. A current I flowing through each inductor L includes a fundamental frequency component $I_{f1}$ and a third harmonic component of the fundamental frequency $I_{3f1}$. Other currents at higher odd harmonics are present but are significantly smaller. To facilitate further explanation regarding operation of ballast 10, reference shall be made hereafter to only one serially connected L-C combination, it being understood that each serially connected L-C combination should be viewed in like manner.

Square wave voltage 13 produces a sinusoidal wave at a fundamental frequency $f_1$ and odd harmonics of the fundamental frequency including a sinusoidal wave at a third harmonic $3f_1$. The amplitude of third harmonic component $f_1$ of voltage E is one third the amplitude of fundamental frequency component $f_1$ of voltage E.

To achieve low switching losses within square wave generator 13 during pre-ignition of lamp load 16 (generally at trailing edges $E_T$ of voltage E), current I is preferably inductive (i.e., current lagging drive voltage) rather than capacitive (i.e. current leading drive voltage) during the voltage transitions of voltage E. Accordingly, the sum of fundamental frequency current component $I_{f1}$ and third harmonic-current component $I_{3f1}$ is inductive wherein $I_{f1}$ and $I_{3f1}$ are the fundamental and third harmonic components of I, respectively. To achieve an overall inductive current I for each serially connected L-C combination, an impedance Z for each serially connected L-C combination as viewed from square wave generator 13 requires that the inductive impedance at the third harmonic $Z_{3f1}$ be less than one third the capacitive impedance at the fundamental frequency $Z_{f1}$. In other words, third harmonic component current $I_{3f1}$ is greater than fundamental frequency component $I_{f1}$. This relationship is illustrated in FIGS. 2(*b*) and 2(*c*) wherein an amplitude P represents the peak value of fundamental frequency current component $I_{f1}$ but is less than the peak value of third harmonic current component $I_{3f1}$. In this way the sum of $I_{f1}$ and $I_{3f1}$ remains inductive at the voltage transitions of voltage E.

Lamp load 16 prior to ignition (i.e. during preignition) appears as an open circuit. This open circuit condition is represented by switch SW in an open state (turned OFF). Following ignition, lamp load 16 is in its steady-state mode of operation and is represented by switch SW being turned on such that lamp load 16 is connected in parallel with capacitor C.

Impedance $Z_{3f1}$, which must be less than one third impedance $Z_{f1}$ during pre-ignition of lamp load 16, is therefore based on switch SW in its open state (i.e., turned off). This condition can be expressed as follows:

$$|Z_{f1}|>|3\ Z_{3f1}| \quad \text{(eq. 1)}$$

That is, $$|2\pi f_1 xL-1/(2\pi f_1 xC)|>3|6\pi f_1 xL-1/(6\pi f_1 xC)| \quad \text{(eq. 2)}$$

Since impedance Z is capacitive at fundamental frequency $f_1$ and inductive at the third harmonic $3f_1$, $$1/(2\pi f_1 xC)-2\pi f_1 xL>18\pi f_1 xL-1/(2\pi f_1 xC)$$

That is, $$1/(2\pi f_1 xC)>5(2\pi f_1 xL) \quad \text{(eq. 3)}$$

Eq. 3 can be rewritten as follows:

$$1/\sqrt{LC}>\sqrt{5}\ 2\pi f_1 \quad \text{(eq. 4)}$$

A resonant frequency $f_0$ of circuit 10 during pre-ignition (i.e., with switch SW open) can be defined as follows:

$$1/\sqrt{LC}=2\pi f_0 \quad \text{(eq. 5)}$$

Substituting the value of $1/\sqrt{LC}$ defined by eq. 4 for the value of $1/\sqrt{LC}$ in eq. 5 results in $$2\pi f_0>\sqrt{5}\ 2\pi f_1 \quad \text{(eq. 6)}$$

Accordingly, resonant frequency $f_0$ can be expressed as follows:

$$f_0>\sqrt{5}\ f_1 \quad \text{(eq. 7)}$$

In other words, third harmonic inductive current component $I_{3f1}$ is greater than fundamental frequency capacitive current component $I_{f1}$ when resonant frequency $f_0$ is about or greater than $\sqrt{5}$ times the fundamental frequency of voltage E. This lower limit can be as low as 2 times the fundamental frequency of voltage E when taking into account the higher harmonic content of the square wave.

To ensure that unsafe voltages and currents present at resonant frequency $f_0$ cannot occur, resonant frequency $f_0$ also should not be equal to the third harmonic frequency $3f_1$ and, preferably, no other odd harmonics of voltage E. Therefore, in accordance with one embodiment of the invention, the values of inductor L and capacitor C should be chosen such that:

$$\sqrt{5}f_1<f_0<3f_1 \quad \text{(eq. 8)}$$

By designing ballast circuit 10 such that resonant frequency $f_0$ is within the range of frequencies defined by eq. 8, the unsafe voltages and currents which occur at resonant frequency $f_0$ during pre-ignition of lamp load 16 are avoided and total current delivered by square wave generator 13 remains inductive. There is no need to vary the frequency of voltage E between resonant frequency $f_0$ during pre-ignition of lamp load 16 and a different frequency immediately thereafter as in conventional ballast circuitry. Feedback circuitry designed to sense ignition of lamp load 16 for determining when to vary the frequency of voltage E from resonant frequency $f_0$ to a different operating frequency can be eliminated. In accordance with one preferred embodiment of the invention, a safer, simpler circuit is provided by maintaining resonant frequency $f_0$ within the boundaries defined by eq. 8.

Figure 3:
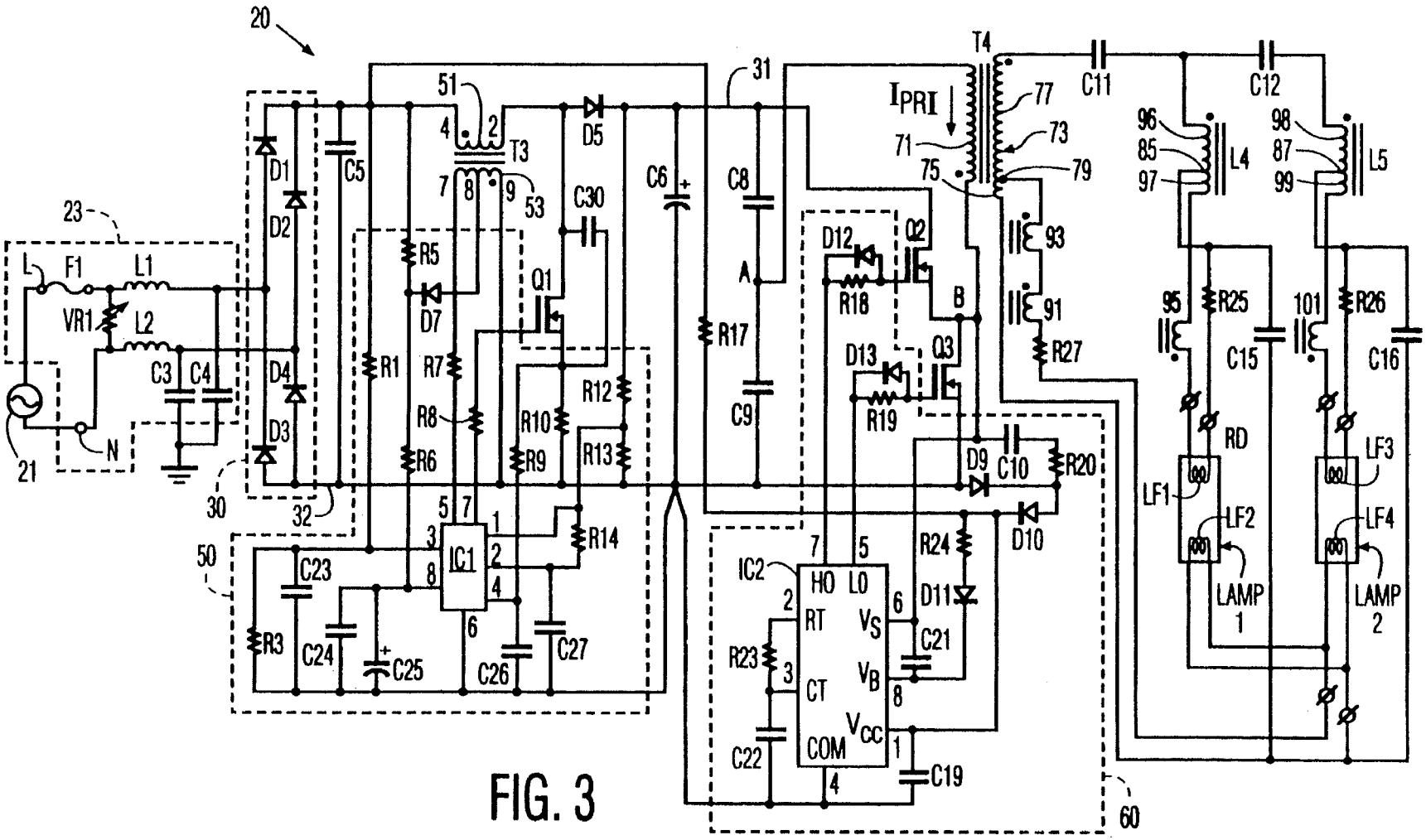
FIG. 3 is a schematic diagram of a ballast circuit in accordance with the invention.
Figure 4A:
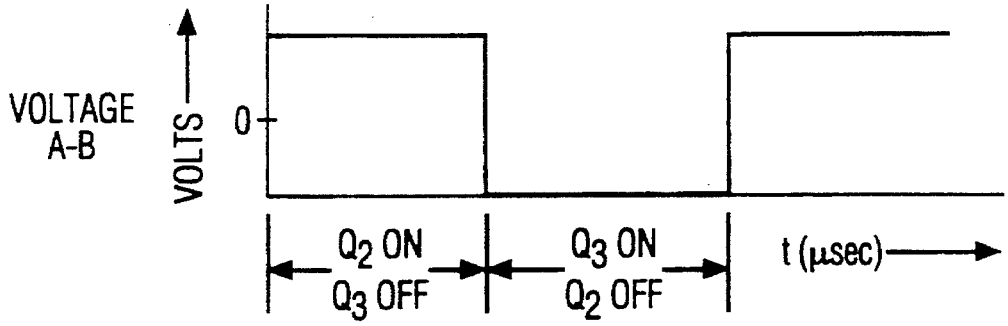
FIGS. 4(*a*), 4(*b*), 4(*c*) and 4(*d*) are timing diagrams of signals produced within the ballast circuit of FIG. 3 during pre-ignition and steady-state operation of the lamp load.
Figure 4B:
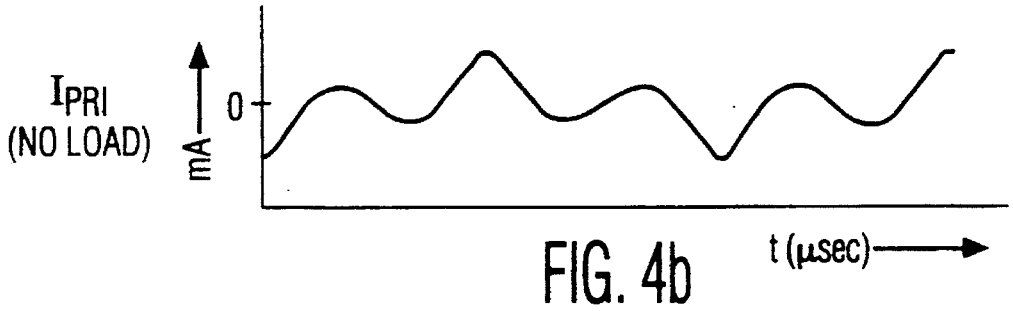
Figure 4C:
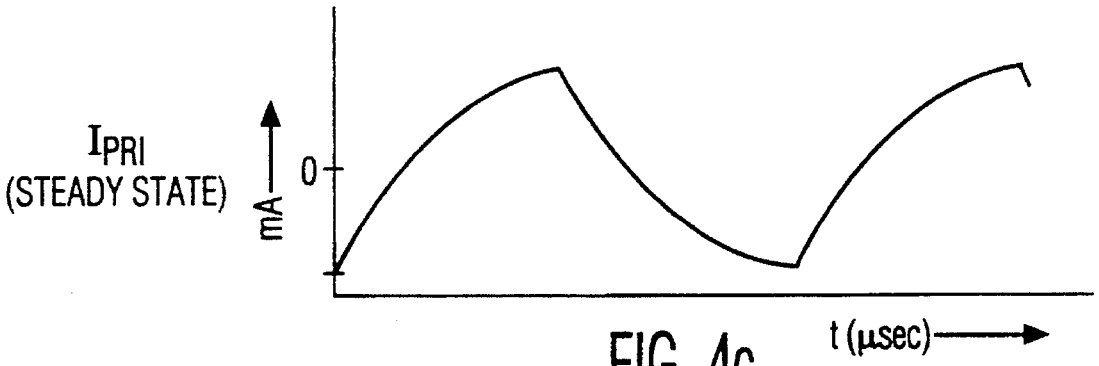
Figure 4D:
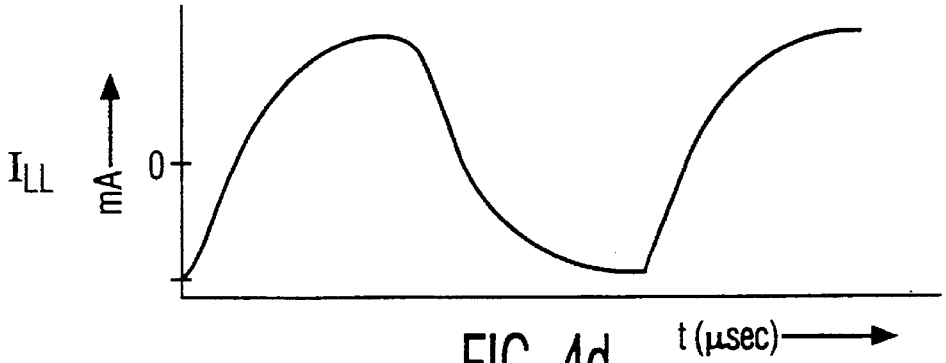

A ballast circuit 20 in accordance with the invention is shown in FIG. 3. The values for and description of the components shown in FIG. 3 are tabularly listed in FIG. 7. The elements within ballast 20 shown in dashed lines include an electromagnetic interference (EMI) suppression filter 23, a full wave rectifier 30, a preconditioner control 50 and a combined level shifter and half-bridge drive 60.

An A.C. source 21 nominally at 120 volts, 60 hertz is connected to a line (L) side input and a neutral (N) side input of ballast 20. The A.C. voltage ($V_{LN}$) of 120 volts, which is referred to herein for exemplary purposes only and is not limited thereto, is applied to EMI suppression filter 23. Filter 23 filters high frequency components inputted thereto lowering conducted and radiated EMI. A fuse F1 of filter 23 protects against fire hazard in the event of component failure within ballast 20. Fuse F1 is connected between the line (L) side input and an inductor L1. A varistor VR1, connected between the junction joining together fuse F1 and inductor L1, prevents line transients from entering and adversely affecting operation of ballast 20. An inductor L2 is connected between the junction joining varistor VR1 and the neutral (N) side input and a first end of a capacitor C3. A capacitor C4 is connected between a junction for grounding capacitor C3 and a junction joining together inductor L1 and rectifier 30.

Filter 23 includes a first filter for rejecting normal mode signals and a second filter for rejecting common mode signals. Capacitors C3 and C4 and inductors L1 and L2 are used for both common and normal mode rejections.

The output of filter 23 is supplied to full wave rectifier 30 which includes diodes D1, D2, D3 and D4. The anode of diode D1 and cathode of diode D3 are connected to the junction joining inductor L1 and capacitor C4 together. The anode of diode D2 and cathode of diode D4 are connected to the junction joining inductor L2 and capacitor C3 together. The cathodes of diodes D1 and D2 are connected to a primary winding 51 of a transformer T3. The anodes of diodes D3 and D4 are connected to a ground bus rail 32.

The output of rectifier 30 (i.e. rectified a.c. signal) is supplied to a boost converter. The boost converter includes transformer T3, a preconditioner transistor Q1, a diode D5, an electrolytic capacitor C6 and preconditioner control 50. The anode and cathode of diode D5 are connected between a primary winding 51 of transformer T3 and capacitor C6, respectively. A capacitor C5, which is connected across the output of rectifier 30 removes the high frequency component from the current being drawn by primary winding 51 of transformer T3.

The boost converter boosts the magnitude of the rectified A.C. signal supplied by rectifier 30, produces a regulated D.C. voltage supply across capacitor C6 and corrects to near unity the power factor of ballast 20. By producing a regulated D.C. voltage having a magnitude greater than the peak of the A.C. signal, the voltage supplied to an inverter (discussed below) is preconditioned. Transistor (switch) Q1 is connected at one end to the junction between primary winding 51 of transformer T3 and the anode of diode D5. The other end of transistor Q1 is connected through a resistor R10 to ground bus rail 32.

Preconditioner control 50, which is powered by a D.C. supply voltage $V_{cc}$, controls the switching duration and frequency of transistor Q1. Preconditioner control 50 includes a preconditioner integrated circuit chip (IC1) having four control input signals. Three of these four control input signals operate in an asynchronous mode (i.e. not in synchronism with the A.C. voltage ($V_{LN}$) supplied by source 21). Preconditioner control 50 can include, but is not limited to, a Motorola MC34262 (DIP-8) Power Factor Controller from Motorola Inc. of Phoenix, Ariz. Transistor Q1 is preferably a MOSFET, the gate of which is connected through a resistor R8 to the drive output (pin 7) of chip IC1.

The first control input signal flows into pin 3 of chip IC1 from the rectified AC line through a resistor divider network including resistors R1 and R3 and a capacitor 23. This first control input signal represents the rectified AC voltage.

The second control input signal flows into pin 5 of chip IC1 from a secondary winding 53 of transformer T3 and represents the current flowing through primary winding 51 of transformer T3. This second control input signal is used to turn on transistor Q1 when the current flow through primary winding 51 is about zero. Chip IC1 responsive to the second control input signal produces a driving signal through resistor R8 to turn on transistor Q1.

The third control input signal is based on a resistor divider formed from resistors R12 and R13 and enters chip IC1 at pin 1. The third control input signal is a DC feedback signal to chip IC1 and represents the DC level across the output of the boost converter (i.e. across capacitor C6).

The fourth control input signal represents current passing through transistor Q1 and a resistor R10. The signal flows along a path from the junction between transistor Q1 and resistor R10 (which serves as a low pass filter) into pin 4 of chip IC1. A capacitor C30, connected across transistor Q1, serves as a snubber capacitor for limiting EMI. Responsive to a combination of the first, second, third and fourth control input signals, chip IC1 turns transistor Q1 on and off.

Figure 5:
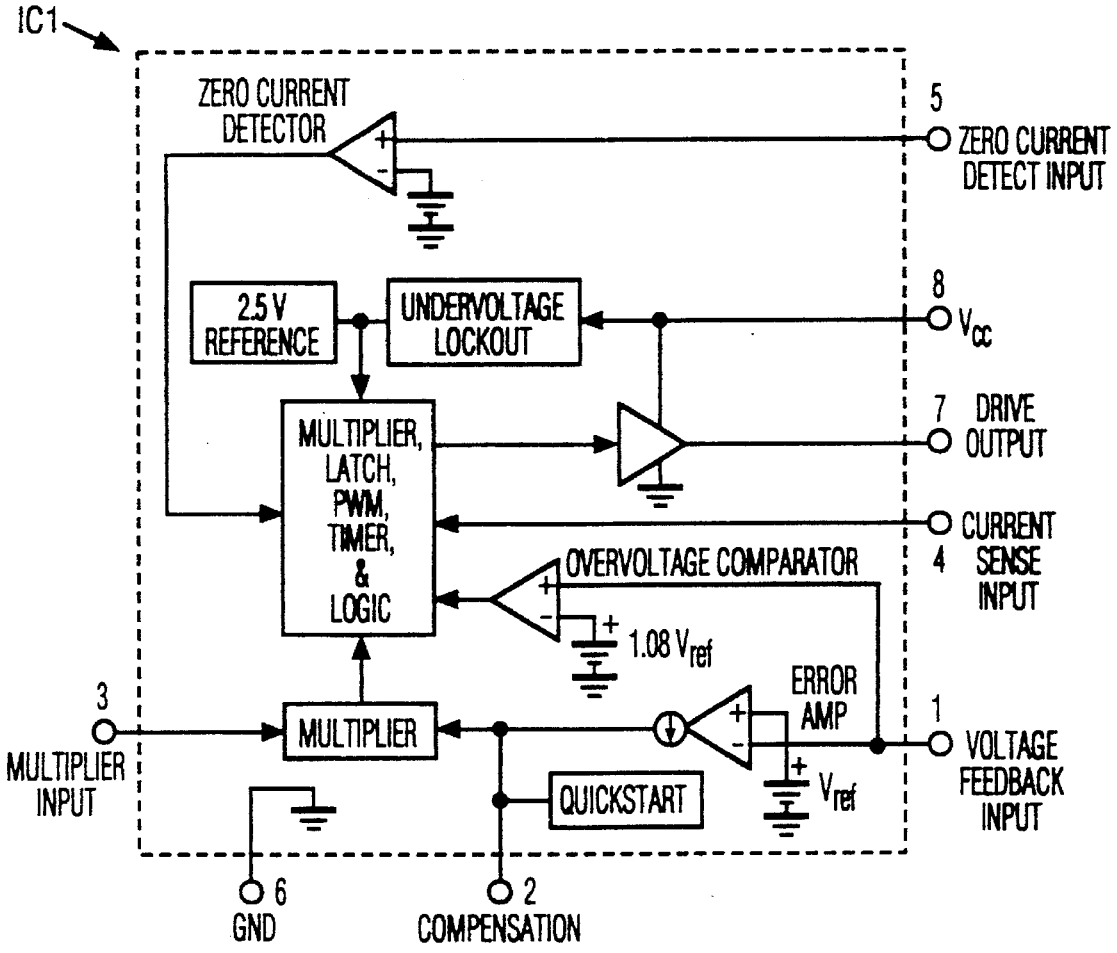
FIG. 5 is a functional block diagram of an integrated circuit chip IC1 within the ballast circuit of FIG. 3.

Referring now to FIGS. 3 and 5, the D.C. level representing the voltage across capacitor C6 (i.e. the output voltage of the boost converter) is applied to an input of an error amplifier 55*a* through pin 1 of chip IC1. The output of error amplifier 55*a*, at pin 2 of chip IC1, is compensated by a resistor R14 and a capacitor C27. Resistor R14 is connected in parallel between pins 1 and 2 of chip IC1. Capacitor C27 is connected between pin 2 and pin 6 of chip IC1. The signal representing the full wave rectified sine wave across capacitor C5 is applied to an input of a multiplier 55*b* through pin 3 of chip IC1. The signal supplied to pin 3 is sensed by resistors R1, R3 and filtered by capacitor C23 to remove noise. Multiplier 55*b* multiplies the signal representing the full wave rectified sine wave with the output of error amplifier 55*a*.

The output of multiplier 55*b* is internally compared with the peak current flowing through transistor Q1 by a self start and detect logic 55*c*. This current is transformed into a voltage applied to pin 4 of chip IC1 after being filtered by resistor R9 and capacitor C26 to remove high frequency components therefrom. An overvoltage comparator 55*d* eliminates the possibility of a runaway output voltage. This condition can occur during initial startup, sudden load removal or during output arcing and is the result of the low bandwidth that must be used in the control loop of error amplifier 55*a*.

Chip IC1 operates as a critical conduction current mode controller whereby output switch conduction is initiated by a zero current detector 55*e* and terminated when the peak inductor current reaches the threshold level established by the output of multiplier 55*b*. Transistor Q1 cannot turn on until the current flowing through primary winding 51 of transformer T3 reaches approximately zero. Zero current detector 55*e* indirectly senses the current flow through primary winding 51 by monitoring when the voltage across secondary winding 53 falls below about 1.6 volts. The voltage across secondary winding 53 is represented by the current flowing into pin 5 of chip IC1 from a resistor R7 serially connected to secondary winding 53. An undervoltage lockout comparator 55*f* monitors the power supply terminal $V_{cc}$ provided at pin 8 to guarantee that IC1 is fully functional before enabling the output stage. The driving signal for turning transistor Q1 on and off is provided at a pin 7 of chip IC1 serving as the drive output terminal. The driving signal is produced by an operational amplifier 55*g* of self start and detect logic 55*c*.

A low voltage power supply for initial startup operations is connected to pin 8 and includes capacitors 24 and 25. When ballast 20 is first turned on, current flowing through resistors R5 and R6 charges capacitor C25. Capacitor C24 is a high frequency bypass capacitor connected in parallel with electrolytic capacitor C25. The time delay associated with the charging of capacitor C25 is used within a program starting mode to provide adequate time to preheat the filaments of each lamp (e.g. Lamp 1 and Lamp 2 discussed below).

For about the first 750 milliseconds after the ballast is first turned on the voltage supplied to the inverter (i.e. across capacitor C6) is about the peak of the A.C. line voltage. The voltage supplied to inverter is commonly referred to as a rail or bus voltage 31 and is about 170 volts. By providing this voltage level for about 750 milliseconds, the lamp filaments can be properly preheated. Approximately 750 milliseconds after the ballast is turned on, preconditioner control 50 starts. By delaying the start of preconditioner control 50, instant starting of Lamp 1 and Lamp 2 is avoided. The voltage supplied to the inverter now increases. The lamp with its filaments already preheated now ignites. The time delay of approximately 750 milliseconds is determined by the time constant based on resistors R5 and R6 and capacitor C25. Supply of power to pin 8 of chip IC1 after the preconditioner begins operating is provided through a tap 8 of secondary winding 53 of transformer T3, diode D7 and resistor R6.

The boost circuitry, commonly referred to as an up-converter, boosts the rectified AC input voltage as follows. When transistor Q1 is closed, primary winding 51 of transformer T3 is short circuited to ground. Current increases through primary winding 51. Transistor Q1 is then opened (turned off). Primary winding 51 with transistor Q1 open transfers stored energy through diode D5 into capacitor C6. The amount of energy transferred to capacitor C6 is based on the time during which transistor Q1 is turned on, that is, based on the frequency and duration of the driving signal supplied to the gate of transistor Q1 through resistor R8 by chip IC1. Asynchronous operation of transistor $Q_1$ with respect to voltage $V_{LN}$ results.

Primary winding 51 operates in a discontinuous mode, that is, the current through primary winding 51 during each cycle is reduced to substantially zero before a new cycle is initiated. The frequency at which transistor Q1 is turned on and off is varied by preconditioner control 50 so that the peak current through primary winding 51 is approximately twice the A.C. line current. The DC voltage across capacitor C6 is kept constant as set by the feedback network of resistors R12, R13 and R14 and capacitor C27. Resistor R17 is connected to the input of primary winding 51 and provides a DC bias as the initial power supply for an integrated circuit chip IC2. Chip IC2 is a self oscillating half bridge driver sold by International Rectifier of El Segundo, Calif. as part no. IR2151 which serves as both a timer, oscillator and level shifter for driving the inverter.

The inverter, which is of the half bridge type, includes a pair of power transistors Q2 and Q3 which serve as switches, a pair of capacitors C8 and C9 and a transformer T4. Level shifter and half-bridge driver 60 produces a pair of square wave driving signals having about a 50—50 duty cycle which are supplied to the gates of transistors Q2 and Q3. These driving signals are approximately 180° out of phase with each other so as to prevent conduction of transistor Q2 and Q3 at the same time, respectively.

The waveforms shown in FIGS. 4(*a*), 4(*b*), 4(*c*) and 4(*d*) produced by ballast circuit 20 are based on the component values shown in FIG. 7. Ballast 20 can power one or more lamps in parallel. As shown in FIG. 4(*a*), the fundamental frequency of the square wave produced by the half-bridge inverter is approximately 28 KHz. The resonant frequency of choke L4 and capacitor C15 (or choke L5 and capacitor C16) is approximately 28 KHz, that is, approximately 2.5 times fundamental frequency $f_1$.

FIG. 4(*a*) illustrates a voltage $V_{AB}$, that is, the output voltage of the inverter which is between terminals A and B of the inverter. Voltage $V_{AB}$ is a train of square wave voltages which is applied across a primary winding 71 of a transformer T4 varying between approximately +118 volts and −118 volts during no load conditions. FIG. 4(*b*) illustrates current $I_{PRI}$ flowing through primary winding 71 during no load conditions, that is, prior to ignition of any lamp load. Once all lamps are ignited and are in their steady-state operation, current $I_{PRI}$ flowing through primary winding 71, as shown in FIG. 4(*c*), has a somewhat sinusoidal wave shape. A pair of capacitors C15 and C16 serve to smooth this somewhat sinusoidal current waveform resulting in a substantially sinusoidal lamp current $I_{LAMP}$ as shown in FIG. 4(*d*) flowing through Lamp 1 and Lamp 2, respectively.

Figure 6:
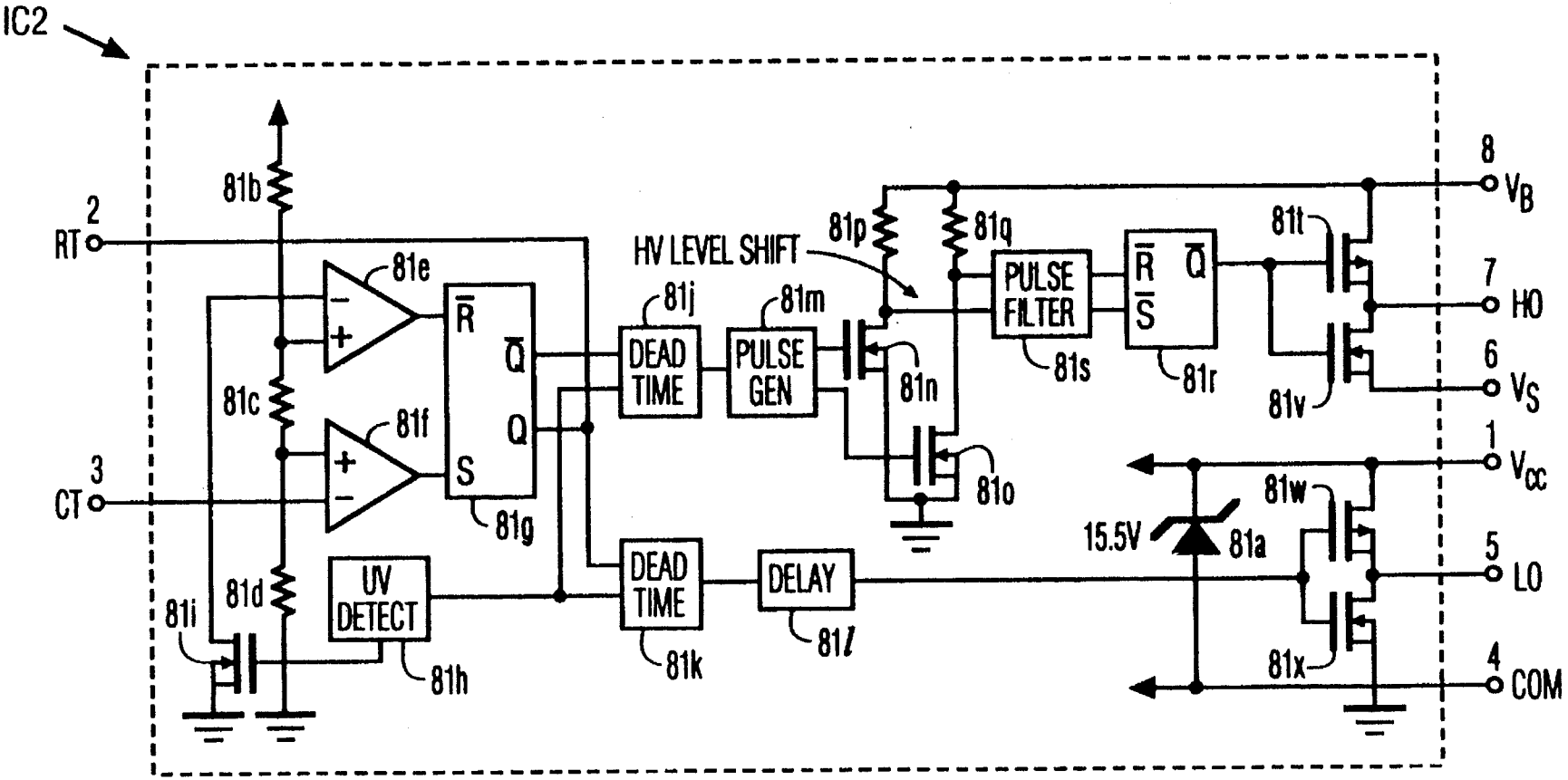
FIG. 6 is a functional block diagram of an integrated circuit chip IC2 within the ballast circuit of FIG. 3.

Referring now to FIGS. 3 and 6, chip IC2 includes an oscillator oscillating at a frequency determined by a resistor R23 and a capacitor C22. Resistor R23 is connected between pins 2 and 3 of chip IC2. Capacitor C22 is connected between pin 3 of chip IC2 and a junction joining together bus rail 32, pin 4 of chip IC2 and one end of a capacitor C19. The driving signal produced at pin 7 of chip IC2 is supplied through a resistor R18 to the gate of transistor Q2. A diode D12 is connected in parallel with resistor R18. The anode and cathode of diode D12 are connected to the gate of transistor Q2 and to pin 7 of chip IC2, respectively. The driving signal produced at pin 5 of chip IC2 is supplied through a resistor R19 to the gate of transistor Q3. A diode D13 is connected in parallel with resistor R19. The anode and cathode of diode D13 are connected to the gate of transistor Q3 and to pin 5 of chip IC2, respectively. Each of these diode, resistor combinations serve to produce a slow turn-on and a fast turn-off of the associated transistor. The slow turn-on limits the rate of rise of dv/dt across each transistor and thereby minimizes EMI associated therewith. The fast turn-off results in low switching losses.

The low voltage supply for chip IC2 is filtered by capacitor C19 between pin 1 and pin 4. Current supply for initial start-up is provided through resistor R17 to capacitor C19. An internal zener diode 81*a* of chip IC2 limits the voltage between pin 1 and pin 4. After chip IC2 begins oscillating, power for the chip is supplied through a power supply. The power supply includes a capacitor C10, a resistor R20 and a pair of diodes D9 and D10. Capacitor C10 is connected to the junction joining together terminal B, primary winding 71 of transformer T4, a pin 6 of chip IC2, a capacitor C21 and one end of resistor R20. The other end of resistor R20 is connected to the junction joining together the cathode of diode D9 and the anode of diode D10. The cathode of D10 is connected to the junction joining together pin 1 of chip IC1, capacitor C19, a resistor R24 and resistor R17. On positive voltage excursions across transistor Q3, capacitor C10 is charged positively. Charging current flows through resistor R20 and diode D10 and is supplied to pin 1. The voltage at pin 1 is raised to the clamping voltage of internal zener diode 81*a*. Charging current above the clamping voltage passes through zener diode 81*a*. On negative voltage excursions across transistor Q3, capacitor C10 discharges through diode D9. Resistor R20 reduces high frequency ringing during these voltage excursions thereby lowering EMI.

The gate drive for transistor Q2 is provided by the charge on capacitor C21 which is between pins 6 and 8 of chip IC2. An anode of diode D11 is connected to resistor R24. The cathode of diode D11 is connected to the junction of pin 8 of chip IC2 and capacitor 21. The voltage across transistor Q3 when turned-on is essentially zero. During this initial time interval, capacitor C21 is charged essentially to one diode drop below the voltage at pin 1 of chip IC2. The voltage at terminal B varies between approximately the voltage of bus rail 31 and the voltage of bus rail 32 depending on the switching states of transistors Q2 and Q3. When transistor Q3 is turned-on, the voltage at pin 8 of chip IC2 is above the voltage at pin 6 of chip IC2 thus charging capacitor C21. A positive voltage supply for gate turn-on and gate turn-off of transistor Q2 results.

The oscillating section of chip IC2 includes three resistors 81*b*, 81*c* and 81*d*, two comparators 81*e* and 81*f* and a flip-flop 81*g*. An undervoltage detector 81*h* and a MOSFET transistor 81*i* set the threshold for turning-on the oscillator of chip IC2. A pair of dead time circuits 81*j* and 81*k* serve to prevent cross conduction between transistors Q2 and Q3. A delay circuit 81*l* serves to delay the driving signal supplied to transistor Q3 so as to compensate for and match any delay introduced in generating the driving signal supplied to transistor Q2. In response to the dead time dictated by dead time circuit 81*j*, a pulse generator 81*m* controls the conduction of a pair of MOSFETS 81*n* and 81*o*. A pair of resistors 81*p* and 81*q* limit the flow of current through MOSFETS 81*n* and 81*o*, respectively. A flip-flop 81*r* receives signals from a pulse filter 81*s* based on the operating states of MOSFETS 81*n* and 81*o* and produces a gate signal for controlling a pair of transistors 81*t* and 81*v*. Transistors 81*t* and 81*v* are serially connected between pins 8 and 6 of chip IC2. Pin 7 of chip IC2 is connected to the junction joining together transistors 81*t* and 81*v*. A pair of transistors 81*w* and 81*x* are serially connected between pins 1 and 4 of chip IC2. A gate signal is supplied from delay circuit 81*l* to the gates of transistors 81*w* and 81*x*. Pin 5 of chip IC2 is connected to the junction joining together transistors 81*w* and 81*x*.

Transformer T4 includes a primary winding 71 and a secondary winding 73 having a winding section 75 and a winding section 77. Winding sections 75 and 77 are connected together at a tap 79 of secondary winding 73. Primary winding 71 of transformer T4 is connected between half bridge capacitors C8,C9 and transistors Q2,Q3, that is, between terminals A and B. One end of winding section 77 is connected to a junction joining together a pair of DC blocking capacitors C11 and C12. Capacitors C11 and C12 block DC currents in the event that Lamp 1 and Lamp 2 begin to act as rectifiers and thereby prevent transformer T4 from saturating, respectively.

A pair of ballasting/current limiting chokes L4 and L5 are serially connected to capacitors C11 and C12, respectively. Choke L4 includes two sections 96 and 97 joined together at a tap 85. Choke L5 includes two sections 98 and 99 joined together at a tap 87. A pair of auxiliary windings 91 and 93 and a resistor R27 are serially connected between tap 79 of secondary winding 73 of transformer T4 and to a junction joining together a filament LF2 of Lamp 1 and a filament LF4 of Lamp 2. Filaments LF2 and LF4 are connected in parallel. Auxiliary windings 91 and 93 are coupled to chokes L4 and L5, respectively.

A capacitor C15 is connected at one end to a junction joining together a resistor R25 and tap 85 of choke L4. The other end of capacitor C15 is connected to a junction joining together winding section 75, filaments LF2 and LF4 and a capacitor C16. Capacitor C16 is connected at its other end to a junction joining together a resistor R26 and tap 87 of choke L5. An auxiliary winding 95, coupled to secondary winding 73, is connected between winding section 97 of choke L4 and a filament LF1 of Lamp 1. Winding section 97, auxiliary winding 95, filament LF1 and resistor R25 are serially connected together so as to form a closed path for controlling the heating of filament LF1. Similarly, an auxiliary winding 101, coupled to secondary winding 73, is connected between winding section 99 of choke L5 and a filament LF3 of Lamp 2. Winding section 99, auxiliary winding 101, filament LF3 and resistor R26 are serially connected together so as to form a closed path for controlling the heating of filament LF3.

Winding section 75, auxiliary windings 91 and 93, resistor R27 and filament LF2 are serially connected together so as to form a closed path for controlling the heating of filament LF2. Similarly, winding section 75, auxiliary windings 91 and 93, resistor R27 and filament LF4 are serially connected together so as to form a closed path for controlling the heating of filament LF4.

Resistors R25, R26 and R27 serve to limit current flow in the event of a short circuit across filaments LF1, LF3 and LF2/LF4, respectively. In the event of a momentary short, these resistors limit the total current flowing through the auxiliary windings and thereby protect the serially connected windings from being damaged. In the event of an extended short circuit across the filament, the associated resistor will fail open without overheating or otherwise presenting a fire hazard to other components within ballast 20.

Choke L4 and capacitor C15 form a tuned resonant circuit. Similarly, choke L5 and capacitor C16 form a tuned resonant circuit. Each resonant circuit is tuned to the same resonant frequency. In accordance with the component values listed in FIG. 7, this tuned resonant frequency is about 2.5 times the operating frequency of the inverter. The values for capacitor C1B and C16 are chosen such that safe open circuit operation is provided, that is, within the range of resonant frequencies defined by eq. 8. Accordingly, no additional circuits to protect ballast 20 are required.

Pre-heating of filaments LF1, LF2, LF3 and LF4 occurs for approximately the first 750 milliseconds after ballast 20 is turned-on. Preconditioner control 50 is turned-on only after this 750 millisecond delay period. In accordance with the invention, it should be understood that the pre-heating period is not fixed to about 750 milliseconds and can be any suitable period for operating a rapid start type of fluorescent lamp. Auxiliary windings 91 and 93 are wound such that the voltages developed across auxiliary windings 91 and 93 are substantially in phase with and substantially add to the voltage developed across winding section 75 during this pre-heating period. Similarly, auxiliary windings 95 and 101 are wound such that the voltages developed across auxiliary windings 95 and 101 are substantially in phase with and substantially add to the voltages developed across winding sections 97 and 99 during this pre-heating period, respectively. The voltages developed across these auxiliary windings during the pre-heating period are relatively small in view of their relatively small number of turns.

Once lamp ignition has occurred, the voltages developed across auxiliary windings 91 and 93, 95 and 101 are substantially out of phase with and substantially subtract from (cancel) the voltage developed across winding sections 75, 97 and 99, respectively. The voltage across each lamp filament is significantly reduced. A reduction (cut back) in filament heating results thereby improving system efficiency.

When ballast circuit 20 is first turned on, prior to preconditioner control 50 being turned on, the input voltage of approximately 120 volts results in a peak voltage of approximately 170 volts peak to peak being applied across primary winding 71 of transformer T4 which is stepped up to approximately 400 volts peak to peak across secondary winding 73. During this time, chip IC1 is turned off and chip IC2 is turned on. Chip IC1 is turned off based on the time delay associated in charging capacitor C25 which serves as the source of power for chip IC1. Chip IC2 is turned-on through the current supplied by resistor R17. Filaments LF1, LF2, LF3 and LF4 are pre-heated.

After approximately 750 milliseconds, capacitor C25 sufficiently charges to turn on chip IC1. A regulated D.C. voltage of approximately 235 volts across capacitor C6 is produced and a voltage of approximately 560 volts peak to peak across secondary winding 73 is generated. The voltage across secondary winding 73 is sufficient for igniting Lamp 1 and Lamp 2. Once Lamp 1 and Lamp 2 are ignited (i.e. during steady-state lamp operation), the voltage across each filament is substantially reduced. This reduction in filament voltage and consequential reduction in filament heating is based on the out-of-phase voltages of auxiliary windings 91, 93, 95 and 101 substantially cancelling the voltages which would otherwise be applied across the filaments. The voltage across each filament can be viewed as the sum of a first voltage and a second voltage wherein the first voltage and second voltage are substantially in phase with each other prior to lamp ignition and are substantially out of phase with each other following lamp ignition. The first voltages are produced by winding sections 75, 97 and 99. The second voltages are produced by auxiliary windings 91, 93, 95 and 101.

Following ignition, each lamp voltage (i.e. voltage across Lamp 1 or Lamp 2) drops to approximately ±220 volts peak with the remainder of the voltage of secondary winding 73 across choke L4 or choke L5, respectively. The number of lamps connected in parallel can be varied as desired with the value of each serially connected choke being chosen so as to provide the desired lamp current during steady-state operation of the lamp.

As now can be readily appreciated, by maintaining the inverter fundamental sinusoidal frequency $f_1$ well below resonant frequency $f_0$ of the series L-C output circuit, the undesirable and unsafe high voltages and current levels produced in conventional ballast circuits during pre-ignition of a lamp are avoided. More particularly, by choosing the values of chokes L4 and L5 and capacitors C15 and C16, respectively, such that the L4,C15 resonant frequency $f_0$ and L5,C16 resonant frequency is defined by eq. 8, the voltage level across chokes L4 and L5 and capacitors C15 and C16 and current flow therethrough will be safe and well defined during pre-ignition.

The invention provides rapid start, parallel and independent lamp operation. Unlike conventional rapid start operation in which the lamps are serially connected, the invention avoids the need for starting capacitors and thereby reduces the level of glow current produced during lamp starting. A much longer lamp life is provided. Unlike conventional instant start, parallel lamp operation, failure of one or more lamps does not adversely affect the performance of any lamps remaining in operation. In particular, each lamp operates independently of one another by providing an independent resonant series circuit (e.g. choke L4 and capacitor C15) associated with each lamp. A ballast in accordance with the invention can operate four rapid start fluorescent lamps in parallel. In the event that one, two or three of these four lamps fail, a ballast in accordance with the invention would continue to operate the remaining lamp(s) as though designed for three, two or one lamp operation. In other words, a change in lamp load does not adversely affect performance of the ballast in properly powering the remaining lamp load.

The resonant frequency $f_0$ can range from approximately at least 2 times the inverter fundamental frequency $f_1$ of the square wave generated by the square wave generator but should exclude those frequencies equal to a higher odd harmonic of the fundamental frequency $f_1$. Unsafe operation (i.e., resonant operation of the series L-C output circuit) of ballast circuit 20 is prevented.

Generally, in calculating the inductance of choke L4 or L5 for determining resonant frequency $f_0$, the inductance of the choke is far greater than the stray inductance or other inductances within ballast circuit 20. Therefore, as a first order approximation, the inductance of choke L4 or L5 can be used without taking into account stray inductances and the like in determining the resonant frequency $f_0$.

As now can be readily appreciated, the generated voltage (i.e. voltage E of FIG. 1 and voltage $V_{A-B}$ of FIG. 4(*a*)) is at a frequency which is far less than the resonant frequency of the series connected L-C circuit and therefore provides safe open circuit (pre-ignition) voltages and current levels. The frequency of this generated signal need not be changed following pre-ignition since it is never at or near resonant frequency $f_0$ of the series connected L-C circuit. Feedback circuitry for sensing ignition of lamp load LL for switching to a different steady-state lamp operating frequency need not be provided. By eliminating the need to operate at resonant frequency $f_0$ of each series L-C circuit during pre-ignition of the lamp load, the value and resulting size of the capacitor for the series connected L-C circuit can be far smaller than normally used in a conventional series connected L-C circuit.

It will thus be seen that the objects set forth above and those made apparent from the preceding description are efficiently attained and, since certain changes can be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A ballast circuit for powering at least two rapid start fluorescent lamps, comprising:

at least two serially connected combinations of a choke and a capacitor, each combination associated with a different lamp; and generating means for applying a generated signal to each serially connected combination, said generated signal having a fundamental frequency;

wherein each combination is characterized by a resonant frequency which is other than an odd harmonic of and at least $\sqrt{5}$ times greater than the fundamental frequency.

2. The ballast circuit of claim 1, wherein the generated signal is a train of square waves.

3. The ballast circuit of claim 1, wherein the generating means includes a half-bridge inverter.

4. The ballast circuit of claim 2, wherein the generating means includes a half-bridge inverter.

5. The ballast circuit of claim 1, wherein the resonant frequency is less than a third harmonic of said fundamental frequency.

6. The ballast circuit of claim 2, wherein the resonant frequency is less than a third harmonic of said fundamental frequency.

7. The ballast circuit of claim 3, wherein the resonant frequency is less than a third harmonic of said fundamental frequency.

8. The ballast circuit of claim 4, wherein the resonant frequency is less than a third harmonic of said fundamental frequency.

9. The ballast circuit of claim 5, wherein each lamp following ignition enters into a steady-state mode of operation in which current therethrough is maintained at a substantially constant level, said generating means during said steady-state mode further operable for continuing to apply said generated signal to each serially connected combination.

10. The ballast circuit of claim 6, wherein each lamp following ignition enters into a steady-state mode of operation in which current therethrough is maintained at a substantially constant level, said generating means during said steady-state mode further operable for continuing to apply said generated signal to each serially connected combination.

11. The ballast circuit of claim 7, wherein each lamp following ignition enters into a steady-state mode of operation in which current therethrough is maintained at a substantially constant level, said generating means during said steady-state mode further operable for continuing to apply said separated signal to each serially connected combination.

12. The ballast circuit of claim 1, wherein each lamp includes a first filament and a second filament and the generating means includes a transformer having a transformer winding and further including at least two auxiliary choke windings and at least two auxiliary transformer windings, each auxiliary choke winding coupled to a different choke, each auxiliary transformer winding associated with a different choke and wherein the auxiliary choke windings and second filaments of each lamp are serially connected together and each auxiliary secondary winding is serially connected to a different first filament.

13. The ballast circuit of claim 12, wherein the transformer winding includes a transformer winding portion serially connected to the auxiliary choke windings and the second filaments of each lamp and each choke includes a choke portion serially connected to the auxiliary transformer winding and first filament of an associated lamp.

14. The ballast circuit of claim 13, wherein the auxiliary choke windings and auxiliary transformer windings are wound such that the voltages thereacross prior to lamp ignition are substantially in phase and following lamp ignition are substantially out of phase with the voltages across the serially connected transformer winding portion and the serially connected choke portions, respectively.

15. The ballast circuit of claim 1 wherein, the resonant frequency is at least two times greater than the fundamental frequency.

16. The ballast circuit of claim 15, wherein the resonant frequency is at least two times greater than the fundamental frequency.

17. The ballast circuit of claim 5, wherein each lamp includes a first filament and a second filament and the generating means includes a transformer having a transformer winding and further including at least two auxiliary choke windings and at least two auxiliary transformer windings, each auxiliary choke winding coupled to a different choke, each auxiliary secondary winding associated with a different choke and wherein the auxiliary choke windings and second filaments of each lamp are serially connected together and each auxiliary transformer winding is serially connected to a different first filament.

18. The ballast circuit of claim 17, wherein the transformer winding includes a transformer winding portion serially connected to the auxiliary choke windings and the second filaments of each lamp and each choke includes a choke portion serially connected to the auxiliary transformer winding and first filament of an associated lamp.

19. The ballast circuit of claim 18, wherein the auxiliary choke windings and auxiliary transformer windings are wound such that the voltages thereacross prior to lamp ignition are substantially in phase and following lamp ignition are substantially out of phase with the voltages across the serially connected transformer winding portion and the serially connected choke portions, respectively.

20. The ballast circuit of claim 1, wherein each capacitor is coupled across a different lamp.

21. The ballast circuit of claim 5, wherein each capacitor is coupled across a different lamp.

22. The ballast circuit of claim 15, wherein each capacitor is coupled across a different lamp.

23. The ballast circuit of claim 1, wherein the serially connected combinations are effectively connected together in parallel.

24. The ballast circuit of claim 21, wherein the serially connected combinations are effectively connected together in parallel.

25. The ballast circuit of claim 22, wherein the serially connected combinations are effectively connected together in parallel.

26. A method for powering at least two rapid start fluorescent lamps, comprising the steps of:

producing a generated signal having a fundamental frequency; and applying said generated signal to at least two serially connected combinations of a choke and a capacitor, each combination associated with a different lamp;

wherein each combination is characterized by a resonant frequency which is other than an odd harmonic of at least $\sqrt{5}$ times greater than the fundamental frequency.

27. The method of claim 26, wherein the generated signal is a train of square waves.

28. The method of claim 26, wherein the generated signal is produced from a half-bridge inverter.

29. The method of claim 27, wherein the generated signal is produced from a half-bridge inverter.

30. The method of claim 26, wherein the resonant frequency of each combination is less than a third harmonic of said fundamental frequency.

31. The method of claim 29, wherein the resonant frequency of each combination is less than a third harmonic of said fundamental frequency.

32. The method of claim 26, wherein each lamp following ignition enters into a steady-state mode of operation in which current therethrough is maintained at a substantially constant level and further including continuing to produce substantially the same generated signal during the steady-state mode.

33. The method of claim 30, wherein each lamp following ignition enters into a steady-state mode of operation in which current therethrough is maintained at a substantially constant level and further including continuing to produce substantially the same generated signal during the steady-state mode.

34. The method of claim 31, wherein each lamp following ignition enters into a steady-state mode of operation in which current therethrough is maintained at a substantially constant level and further including continuing to produce substantially the same generated signal during the steady-state mode.

35. The method of claim 26, further including the step of applying the sum of a first voltage and a second voltage across a filament of one lamp, wherein the first voltage and second voltage are substantially in phase with each other prior to lamp ignition and are substantially out of phase with each other following lamp ignition.

36. The method of claim 35, further including the step of applying the sum of one of three first voltages and one of three second voltages across the four filaments of two lamps, wherein the first voltage and second voltage of each sum are substantially in phase with each other prior to lamp ignition and are substantially out of phase with each other following lamp ignition.

37. The method of claim 30, further including the step of applying the sum of a first voltage and a second voltage across a filament of one lamp, wherein the first voltage and second voltage are substantially in phase with each other prior to lamp ignition and are substantially out of phase with each other following lamp ignition.

38. The method of claim 35, further including the step of applying the sum of one of three first voltages and one of three second voltages across the four filaments of two lamps, wherein the first voltage and second voltage of each sum are substantially in phase with each other prior to lamp ignition and are substantially out of phase with each other following lamp ignition.

39. The method of claim 31, further including the step of applying the sum of a first voltage and a second voltage across a filament of one lamp, wherein the first voltage and second voltage are substantially in phase with each other prior to lamp ignition and are substantially out of phase with each other following lamp ignition.

40. The method of claim 39, further including the step of applying the sum of one of three first voltages and one of three second voltages across the four filaments of two lamps, wherein the first voltage and second voltage of each sum are substantially in phase with each other prior to lamp ignition and are substantially out of phase with each other following lamp ignition.

41. The method of claim 26, wherein the resonant frequency is at least two times greater than the fundamental frequency.

42. The method of claim 30, wherein the resonant frequency is at least two times greater than the fundamental frequency.

* * * * *